US007484536B2

(12) United States Patent
Debaes et al.

(10) Patent No.: US 7,484,536 B2
(45) Date of Patent: Feb. 3, 2009

(54) DOBBY DEVICE FOR CONTROLLING THE MOTIONS OF AT LEAST ONE WEAVING FRAME OF A WEAVING MACHINE, AND A WEAVING MACHINE PROVIDED WITH SUCH A DOBBY DEVICE

(75) Inventors: Johny Debaes, Moorslede (BE); Dominique Maes, Dentergem (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 19 days.

(21) Appl. No.: 11/827,289

(22) Filed: Jul. 11, 2007

(65) Prior Publication Data

US 2008/0011384 A1 Jan. 17, 2008

(30) Foreign Application Priority Data

Jul. 11, 2006 (BE) ..... 2006/0370

(51) Int. Cl.

| | |
|---|---|
| ***D03C 1/10*** | (2006.01) |
| ***D03C 1/16*** | (2006.01) |
| *D03D 51/00* | (2006.01) |
| *D03D 13/00* | (2006.01) |

(52) U.S. Cl. ..... 139/66 A; 139/1 R; 139/55.1; 139/66 R

(58) Field of Classification Search ..... 139/1 R, 139/55.1, 66 R, 66 A

See application file for complete search history.

(56) References Cited

U.S. PATENT DOCUMENTS

| | | | | |
|---|---|---|---|---|
| 2,915,911 | A * | 12/1959 | Hebeler et al. | 74/393 |
| 3,848,642 | A * | 11/1974 | Steiner | 139/28 |
| 4,285,370 | A * | 8/1981 | McGinley | 139/460 |
| 4,393,902 | A * | 7/1983 | Brock | 139/76 |
| 4,412,563 | A * | 11/1983 | Kleiner | 139/66 R |
| 4,487,233 | A * | 12/1984 | Steiner | 139/28 |
| 2006/0162801 | A1 * | 7/2006 | Debaes | 139/55.1 |

FOREIGN PATENT DOCUMENTS

| | | |
|---|---|---|
| DE | 2922319 | 12/1980 |

* cited by examiner

*Primary Examiner*—Bobby H Muromoto, Jr.
(74) *Attorney, Agent, or Firm*—James Creighton Wray

(57) ABSTRACT

The invention relates to an electronic dobby device (100) for controlling the motions of at least one weaving frame of a weaving machine, wherein the at least one weaving frame is connected to two rotors (1,2) by means of a rod and lever system, wherein each rotor (1,2) is mounted on a rotor shaft (5,6) by means of an eccentric bearing, and wherein each rotor (1,2) is individually selected to be connected or not to the rotor shaft (5,6) by means of one or several selection elements in accordance with the weaving pattern to be woven, in order to move between two possible positions that can be taken up by the rotor (1,2) with respect to the rotor shaft when the rotor (1,2) is disconnected from the rotor shaft (5,6) by the selection elements, wherein the said two rotors (1,2) each are eccentrically journalled on a different rotor shaft (5,6) and both rotor shafts (5,6) are rotating continuously and for rotating over a complete rotation require the same period of time, and in that the said weaving frame can take up at least three different positions during each machine cycle to weave the required weaving pattern. On the other hand, the invention relates to a weaving machine provided with such a dobby device (100).

24 Claims, 4 Drawing Sheets

DOBBY DEVICE FOR CONTROLLING THE MOTIONS OF AT LEAST ONE WEAVING FRAME OF A WEAVING MACHINE, AND A WEAVING MACHINE PROVIDED WITH SUCH A DOBBY DEVICE

On the one hand, the invention relates to an electronic dobby device for controlling the motions of at least one weaving frame of a weaving machine, wherein the at least one weaving frame is connected to two rotors by means of a rod and lever system, wherein each rotor is mounted on a rotor shaft by means of an eccentric bearing, and wherein each rotor is individually selected to be connected or not to the rotor shaft by means of one or several selection elements in accordance with the weaving pattern to be woven, in order thus to move between two possible positions which may be taken up by the rotor with respect to the rotor shaft, when the rotor will be disconnected from the rotor shaft by the selection elements. On the other hand, the invention relates to a weaving machine that is provided with such an electronic dobby device.

When in the weaving process an electronic dobby device is used, the warp yarns are usually positioned during the shed forming, by having these warp yarns to extend through heddle eyes of heddles which have been incorporated in a weaving frame, and wherein the electronic dobby device moves the weaving frame between two positions in accordance with a programmed weaving pattern. The two positions, between which the weaving frame moves in accordance with the programmed weaving pattern are realized within the dobby device by means of rotors that are eccentrically journalled on a continuously rotating shaft, and that are controlled by an electronic selection system in order to be coupled or not to the rotating shaft in order to rotate with this shaft through an angle of 180° in case of being connected, such that the rotor is shifted for a distance of twice the eccentricity between the rotor shaft and the eccentric bearing such that the rotor takes up the other of the two positions and in this position is disconnected from the rotor shaft. This rotor displacement causes the movement of the weaving frame to the other of the two positions. Such a method is described in EP 0 234 321.

However, two-position shed forming is not enough to serve all applications. Also three and four-position shed forming is necessary.

Like this the forming of a three-position shed is necessary for controlling:

- pile warp yarns in a double gripper weaving machine, wherein the pile warp yarns, when forming pile, have to move between the two utmost positions outside the grippers, or when being interlaced as a dead pile or for realizing a W-weave has to be positioned between the grippers;
- backing warp yarns in a three-gripper weaving machine. Herewith, one or two wefts are inserted alternately in one backing fabric. The weaving pattern may require that the backing warp yarns have to be positioned above, below as well as between the grippers, during the machine cycles wherein two wefts are inserted into that one backing fabric;
- backing warp yarns in a four-gripper weaving machine, wherein the same requirements may be posed as for the backing warp yarns in a three-gripper weaving machine;
- pile warp yarns when weaving double-sided usable fabrics on a single-gripper weaving machine in accordance with the method as described in EP 1 593 765, wherein the figure forming is short repetitive, such that the pile warp yarns can be distributed among a limited number of weaving frames (less than 12).

Four-position shed forming is used for controlling pile warp yarns on a three-gripper weaving machine, wherein the figure forming is short repetitive such that the pile warp yarns can be distributed among a limited number of weaving frames (less than 12). Herewith, the pile warp yarns will have to be able to take up the following four positions:

above the upper gripper;
between the upper and the central gripper;
between the central and the lower gripper;
below the lower gripper.

In U.S. Pat. No. 4 412 563, a device is described with a four-position shed forming that is controlled by means of an electronic dobby device. The extremities of two rotors that are situated next to one another on the same rotor shaft and that are eccentrically journalled on this rotor shaft are linked to a common bar or by means of a common rod system. As described above, both rotors each may take up two positions, such that the combinations of the various positions of both rotors result in 2 times 2 positions which may be controlled by the connecting rod or the rod system. Furthermore, the rod or the rod system is connected to the weaving frame which consequently in turn may be shifted into 4 positions.

However, such a device has the disadvantage that two rotors are necessary on the rotor shaft for each weaving frame to be driven. This means that the weaving frames in their assembly in the weaving machine are following one another at a pitch which at least is twice the pitch of the rotor or oppositely that the pitch distance between both rotors on the rotor shaft may maximally be half the pitch of the weaving frames. By pitch of the rotors or of the weaving frames is meant the distance between the front of a first rotor or weaving frame respectively and the front of the next rotor or weaving frame respectively, when looking in the warp direction.

Consequently, either the weaving frames are situated far apart, such that, since the shed opens up at an angle from the fabric line towards the supply of the warp yarns, the weaving frame that is situated farthermost from the weaver has to realize a larger shed, or the rotors have to be made very narrow. Realizing a larger shed with the weaving frames is disadvantageous for the speed to be worked at. Narrow rotors have the disadvantage that they can manage less load of the pile warp yarns, and that the bearings that are installed eccentrically between the rotor and the rotor shaft are not commercially available as a standard on the market and have to be developed and produced to measure, which will cause such a dobby device to become expensive. Moreover, an axial displacement between the ends has to be realized in one or both rotors or in the rod system in accordance with the rotor shaft in order to link both rotors situated one behind the other to one weaving frame. The components wherein this axial displacement is realized are expensive and an axial displacement causes axial forces and resulting couples which exert a supplementary load on the device.

In EP 0 059 232, a device is described wherein rotors that each bare eccentrically journalled on a different shaft and that are linked to a connecting rod which, in turn, in the middle between the connections to both rotors, is connected to a rod system driving a weaving frame. The connecting rod may take up three positions which, by the rod system, is transferred to two positions of the weaving frame. The purpose that herewith is aimed at is to render the selection time required for the selection element to connect or not the rotor to the rotor shaft less critical and to cause it to rotate or not together with the eccentric shaft through an angle of 180° as a function of the shed forming process. In order to attain this effect, both rotor shafts are made to rotate successively and to stop, wherein the one rotor shaft rotates while the other stops, and wherein the selection of the rotor to be connected to the rotor shaft or not, or to be disengaged from the rotor shaft or not happens while the rotor shaft is stationary.

The disadvantage of this device is that there are only two positions wherein the weaving frames are controlled, and that the alternate rotation or stand still does not allow the two rotor shafts to take up three or four positions in each cycle, even when using a different rod system.

The purpose of the invention consists in providing an electronic dobby device in accordance with the preamble of the first claim, not having the disadvantages mentioned above, and to provide a weaving machine with such a dobby device wherein in open shed three or four positions can be realized. By "in open shed" is meant that the device is able to take up at least three positions during each machine cycle.

This purpose of the invention is attained by providing an electronic dobby device for controlling the motions of at least one weaving frame of a weaving machine, wherein the at least one weaving frame is connected to two rotors by means of a rod and lever system, wherein each rotor is mounted on a rotor shaft by means of an eccentric bearing, wherein each rotor is individually selected to be connected or not to the rotor shaft by means of one or several selection elements in accordance with the weaving pattern to be woven, in order to move between two possible positions which may be taken up by the rotor with respect to the rotor shaft when the rotor is disconnected from the rotor shaft by the selection elements, wherein the said two rotors each are eccentrically journalled on a different rotor shaft and both rotor shafts are rotating continuously and for rotating over a complete rotation require the same period of time, and in that the said weaving frame can take up at least three different positions during each machine cycle to weave the required weaving pattern.

In a first preferred embodiment of an electronic dobby device according to the invention, both said rotor shafts are rotating in the same direction.

In another preferred embodiment of an electronic dobby device according to the invention, both said rotor shafts are rotating in an opposite direction.

To attain a standstill to couple a rotor to its respective rotor shaft, the rotating motion of both rotor shafts is modulated, wherein this modulation is the same for both rotor shafts. However, this may also be chosen differently.

In a first particular embodiment of an electronic dobby device according to the invention, the weaving machine is provided with a main drive shaft, wherein both rotor shafts are mechanically connected to this main driving shaft.

In a second particular embodiment of an electronic dobby device according to the invention, both rotor shafts are driven by one and the same stepping motor or servomotor with an intermediate driving mechanism with an input shaft that is connected to the output shaft of the stepping motor or servomotor and with two output shafts each of them connected to one of the two rotor shafts.

In a third particular embodiment of an electronic dobby device according to the invention, both rotor shafts may be separately driven by a stepping motor or a servomotor. This arrangement will enable a greater flexibility when adjusting the device.

When the device is driven by means of a stepping motor or servomotor, a control is provided for coordinating the synchronization of the drive of the said rotor shafts with the main driving shaft of the weaving machine.

Furthermore, the selection elements that select whether the rotors are connected or not to the rotor shaft are preferably carried out as actuators realizing the connection and disconnection between the rotor and rotor shaft. This is usually done when the rotor shaft stands still. The reason why is that with a dobby device that is mechanically connected to the main shaft of the weaving machine, a modulator causes a standstill for the selection, whereas the main shaft and the other shafts that are derived from the main shaft will continue to rotate, such that it will be possible to mechanically connect a selection motion to these moving shafts. However, in case the rotor shaft is driven by an independent servomotor or stepping motor, there is no sense in mechanically connecting a selection motion to the main shaft or to a shaft of the weaving machine derived from the main shaft. Drive with a servomotor or a stepping motor implies a great flexibility which is annulled by connecting a selection motion to the main shaft. In turn, there is no sense in connecting the selection motion to the motor shaft of the independent motor driving the rotor shaft as the selection motion has to function when the rotor shaft will be stationary. This situation is contradictory because the stationary rotor shaft is not capable of driving a selector in order to realize the connection/disconnection. Therefore, the selectors are driven individually by an own actuator realizing the coupling between rotor and rotor shaft.

In a first preferred embodiment of a dobby device according to the invention, the extremities of each of both rotors may be connected to a first lever that hinges around a shaft with a fixed center axis and wherein the first two levers are connected to a common second lever.

In that case, it is possible that the first levers are connected to the common second lever by means of one or several connecting rods.

More preferred, the second levers therewith are connected directly to the common second lever, wherein one of the rotors is connected to a fixed point through a hinging arm. This fixed point may be situated anywhere in the weaving machine. However, in order to be able to pre-assemble the dobby device as a separate unit, in practice, the fixed point is usually situated in the dobby device.

The second lever therewith moves in accordance with a superposition of motions that are generated by the first rotor on the first rotor shaft and of motions that are generated by the second rotor on the second motor shaft enabling the second lever to reach four positions.

In a preferred embodiment of an electronic dobby device according to the invention, the rod system that is constituted by the said first and second levers and the possible connection rods, is provided in such a way that two of the four positions which may be taken up by the second lever coincide in order to enable the weaving frames to be brought into three positions. In this manner, an electronic dobby device is realized which is able to bring weaving frames into three or four positions dividing the rotors between two rotor shafts. Dividing the rotors between two rotor shafts has the advantage that less rotors have to be installed on the same shaft, through which:

- the electronic dobby device becomes more compact as to depth, the length of the rotor axis becomes shorter and the central deflexion of the rotor shaft may be limited which is advantageous in the field of rigidity;
- for a same depth of the dobby and a same length of the axis of the rotor shafts, heavier rotors, i.e. rotors having a larger width, can be used by which with higher loads of warp yarns can be worked and by which also higher speeds can be reached.

the pitch of the rotors can be better tuned to the pitch of the weaving frames (for instance, by making both pitches substantially the same). Due to this, the first levers that connect the rotors with the second levels do no longer have their ends to be displaced axially in order to be connected to the weaving frames to realize the most compact arrangement of the weaving frames. Because of this, the tension of the warp yarns after having been transmitted through the weaving frames and a rod and lever system will no longer exert a moment on the first levers, by which no axial bearing has to be provided anymore on the shaft with the fixed center around which the first lever is rocking.

In another preferred embodiment of an electronic dobby device according to the invention, both rotors are connected to one and the same first lever which, is connected to a second lever by means of a connecting rod.

One extremity of the second lever is herewith preferably connected hingedly to a shaft with a fixed center, and in that the other extremity is connected to a lever and rod system realizing the connection with a weaving frame.

The couplings of the connecting rod to the first and second lever respectively are preferably adjustable, through which the positions taken up by the free extremity of the second lever are adjusted with respect to one another. This enables, for instance, to install the backing warp yarns in a face-to-face weaving machine asymmetrically, such that the shed forming of the backing warp yarns of the lower fabric is different from the shed forming of the backing warp yarns of the upper fabric, which under certain circumstances may be important from a weaving technological viewpoint, for instance to guide the weft insertion means in the lower fabric on backing warp yarns during their movement through the shed.

In a particular embodiment of an electronic dobby device according to the invention, both rotors are installed in a same plane perpendicular to their respective rotor shafts.

The first levers or the second lever that are connected to a rotor may be attached to the respective rotors by means of a single-sided connection. This means that the first lever or the second lever is extending on one side of the rotor there where they are connected to one another. In this case, the levers are of a simple construction, although this embodiment generates a couple on the rotor because of the eccentric transmission of the load exerted by the warp yarns on the rotor.

In order to avoid this, the first levers or the second lever are connected to their respective rotors by means of a double-sided connection. This means that either the extremity of the rotor extends around the lever, for instance, through a radial recess at the extremity of the rotor, or that the lever extends around the rotor, for instance, through a radial recess at the extremity of the lever. This will strongly enhance the stability of the connection between the rotors and the lever which, in turn, are connected to the rod system driving the weaving frames.

In an advantageous embodiment of a dobby device according to the invention, the rotors are installed next to each other on their respective rotor shafts, at a pitch which is equal to the pitch at which the weaving frames are installed in the weaving machine one after the other.

Preferably, the rotors have a thickness substantially corresponding to the thickness of a weaving frame.

On the other hand, the purpose of the invention is attained by providing a weaving machine provided with an electronic dobby device according to the invention as described above.

In order to further clarify the properties of the present invention and to point out its additional advantages and particulars, a more detailed description of the various embodiments of an electronic dobby device for a weaving machine according to the invention will now follow. It may be obvious that no part of the following description may be interpreted as a restriction of the protection of the dobby device according to the invention demanded for in the claims.

Furthermore, some of these embodiments are discussed in the figures herewith attached, wherein reference is made to these figures by means of reference numbers, wherein:

DETAILED DESCRIPTION OF THE PREFERRED EMBODIMENTS

Figure 1:
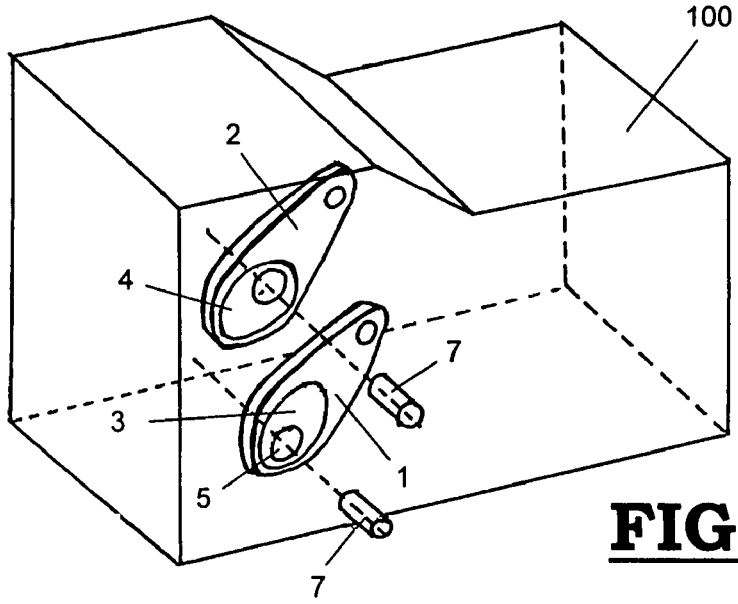
FIG. 1 represents a perspective view of a dobby device according to the invention.

As represented in FIG. 1, in an electronic dobby device (100) according to the invention, for controlling the motions of at least one weaving frame of a weaving machine, the at least one weaving frame is connected to two rotors (1,2) through a rod and lever system, wherein each rotor (1,2) is journalled eccentrically (3) on a rotor shaft (5,6). Each rotor (1,2) is individually selected by means of one or several selection elements (not represented in the figures) in accordance with the weaving pattern to be woven, in order to be connected or not to the rotor shaft (5,6), thus to move between two possible positions which may be taken up by the rotor (1,2) with respect to the rotor shaft (5,6) when the rotor (1,2) is disconnected from the rotor shaft (5,6) by means of the selection elements. The said two rotors (1,2) each are eccentrically journalled on a different rotor shaft (5,6) and both rotor shafts (5,6) rotate continuously and need the same period of time for rotating through a complete rotation. In other words, both rotor shafts (5,6) perform a same number of rotations within a same period of time. Furthermore, the said weaving frame can take up at least three different positions during each machine cycle, generated by the at least three different positions (I, II, III, IV) taken up by the intermediate rods and levers, in order to weave the required weaving pattern.

The two rotor shafts (5,6) may therewith rotate in the same direction or in a different (opposite) direction. The modulation on the rotating motion of each rotor shaft (5,6) that brings the rotor shaft (5,6) to a standstill for a short moment in order to enable a possible coupling of the rotors (1,2) with their respective rotor shaft (5,6), may be the same for both rotor shafts (5,6) but may also be chosen to be different.

Both rotor shafts (5,6) may be connected mechanically to the main drive shaft of the weaving machine. The rotor shafts (5,6) may also be driven by a stepping motor or a servomotor (7). Both rotor shafts (5,6) may be driven by one and the same stepping motor or servomotor (7) with an intermediate driving mechanism with an input shaft which is connected to the output shaft of the stepping motor or servomotor or to two output shafts that each are connected to one of the two rotor shafts (5,6). However, both rotor shafts (5,6) may also be driven separately by a stepping motor or a servomotor (7), by which a greater flexibility is offered towards adjustment. When driving the rotor shafts (5,6) by means of one or several stepping motors or servomotors (7), the selection elements that take care that the rotors (1,2) are connected or not to the respective rotor shafts (5,6) may be carried out as actuators that realize the connection or disconnection between rotor (1,2) and rotor shaft (5,6).

Furthermore a control device (not represented in the figures) is provided that coordinates the synchronization of the drive of the said rotor shafts (5,6) and the selection elements with the drive of the main drive shaft of the weaving machine.

Figure 2:
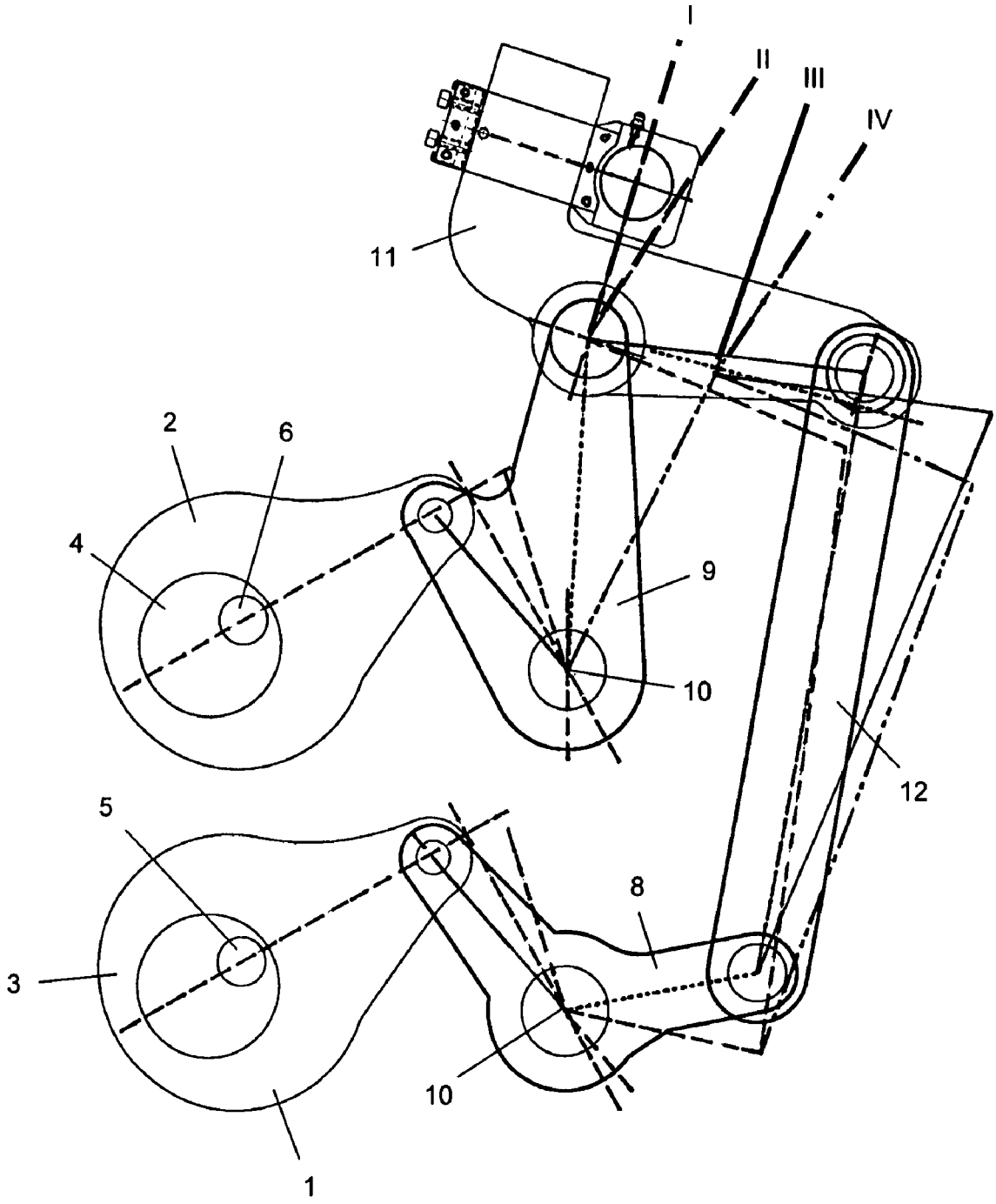

As represented in FIG. 2, the extremities of each one of the rotors (1,2) may be connected to a first lever (8,9) which hinges round a shaft (10) with a fixed center axis and the two first levers (8,9) connected to a common second lever (11). The first levers (8,9) may therewith be connected to the common second lever (11) by means of one or more connecting rods (12).

Preferably, the rotors (8,9) are installed on their respective rotor shafts (5,6) at a pitch being equal to the pitch at which the weaving frames are installed one behind the other in the weaving machine. Preferably, the thickness of the rotors (8,9) substantially corresponds to the thickness of a weaving frame.

According to the state-of-the-art, the pitch at which the weaving frames are installed one behind the other in velvet weaving machines amounts for instance 18 mm. The currently available rotors for dobby devices for flat weaving machines have a thickness enabling their installation next to each other on the rotor shaft at a pitch of 12 mm.

In the state-of-the-art, a three-position electronic dobby device for velvet, is realized by installing two rotors per weaving frame, as used in flat weaving machines, next to each other on the same shaft (the total pitch across 2 rotors being 24 mm). The weaving frames are installed at a pitch of 18 mm in order to restrict the overall dimension of the package of weaving frames as much as possible (in order to limit the lift to be realized by the weaving frames to form the shed). Each pair of rotors have a width of 2×12 mm, and are connected to first levers at the same pitch of 2×12 mm, that are connected together with one second lever which each time is carried out with 6 mm more axial displacement of his two ends, in order to realize the transition of the position of the rotors at 2×12 mm to the position of the weaving frames at 18 mm in order to maintain the packages of weaving frames compact. Because of this displacement the force generated by the tension of the warp yarns exerts a couple on the second lever with axially displaces end through weaving frames and rod system, that causes a radial load as well as an axial load on the shaft of the lever around which the second levers hinge. For this reason, the said lever shaft has to be axially journalled.

Now, according to the invention, by dividing the rotors (1,2) over two different rotor shafts (5,6), the rotors (1,2) may be installed on the rotor shaft (5,6) at the same pitch as the pitch of the weaving frames, i.e. 18 mm. Because of it, the rotors (1,2) can be made stronger having a thickness of 17 mm, for instance, instead of 12 mm. Thus, a three- or four-position electronic dobby device (100) may be realized that is able to manage much higher loads and wherein it is no longer required to make use of second levers (11) with axially displaced ends, such that the load of the warp yarn on the axis onto which the first levers (8,9) are hinging remains limited to an almost radial load and an axial bearing of the second levers (11) on their shaft can be avoided. The use of wider rotors (1,2) may also offer the advantage that standard bearings can be used to journal the rotors (1,2) eccentrically on the rotor shaft (5,6). It is usual to use specifically developed bearings or integrated bearings to journal the eccentric disk (3,4) and the rotor (1,2) when constructing a dobby device, because normally for the loads and speeds that are used in weaving machines for producing flat fabrics, the dimensions of the rotor (1,2) as to thickness are comparatively small with respect to the diameter of the rotor shaft (5,6), Bearings in this ratio of width with respect to the diameter are not commercially available and therefore also often are used as special bearings or integrated bearings. By using wider rotors (1,2) on shorter rotor shafts (5,6), a ratio of bearing width to bearing diameter may be obtained which indeed is commercially available, by which the price of these bearings when produced in smaller quantities yet remains interesting and notably lower than in case special bearings should herefore have to be manufactured.

Figure 3:
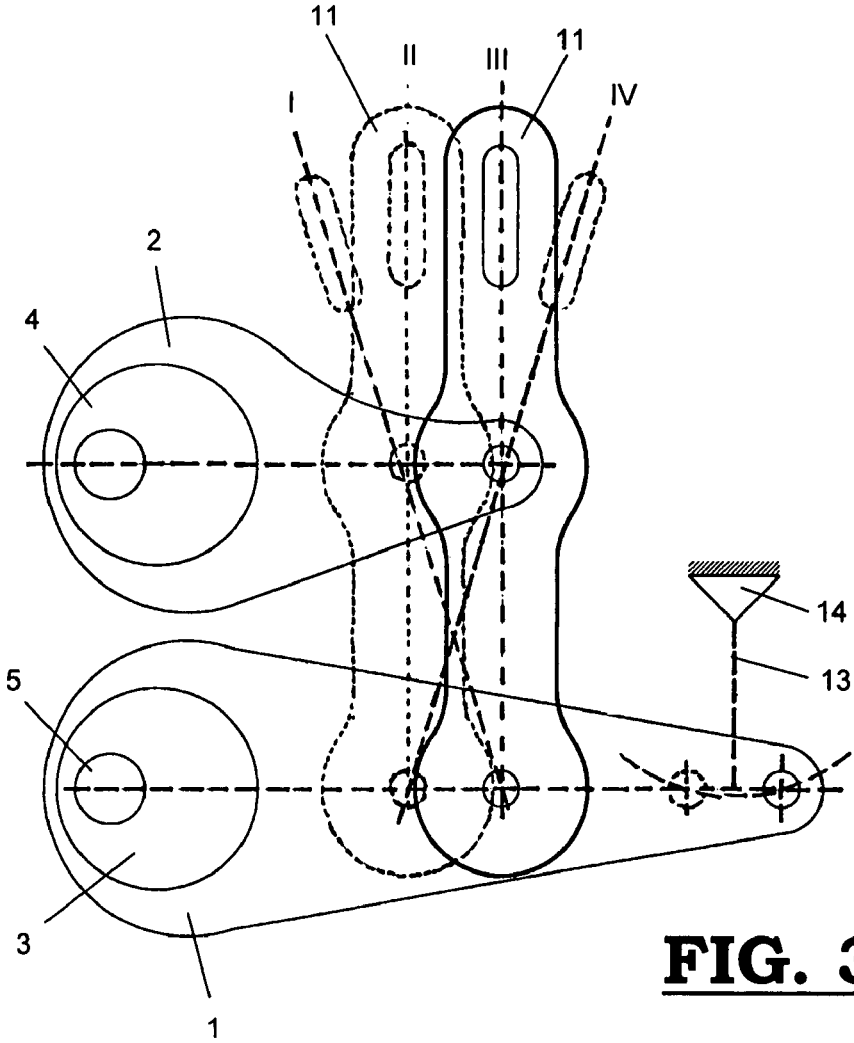
FIGS. 2 and 3 represent schematic views of a dobby device according to the invention with a lever system to realize four positions with two rotors.

The embodiment as represented in FIG. 2 and as described above has indeed the disadvantage that it contains many pivoting points, levers and connecting rods. This is disadvantageous both for the cost prize as well as the cost of maintenance of the dobby device (100). This problem is solved by connecting the two rotors (1,2) directly by means of a second lever (11) which in turn is connected to the weaving frame by means of a lever and rod system known, as is represented in FIG. 3. One of the rotors (1,2), in FIG. 3 this is the first rotor (1), still is connected to a fixed point (14) through a hinged arm (13), for instance to the frame of the dobby device (100). As already mentioned above, this fixed point (14) however may be situated also in some other part of the weaving machine. The two positions of the second rotor (2) result in four positions of the second lever (11). This embodiment has the advantage that the number of pivoting points and the number of components is strongly reduced.

Figure 4:
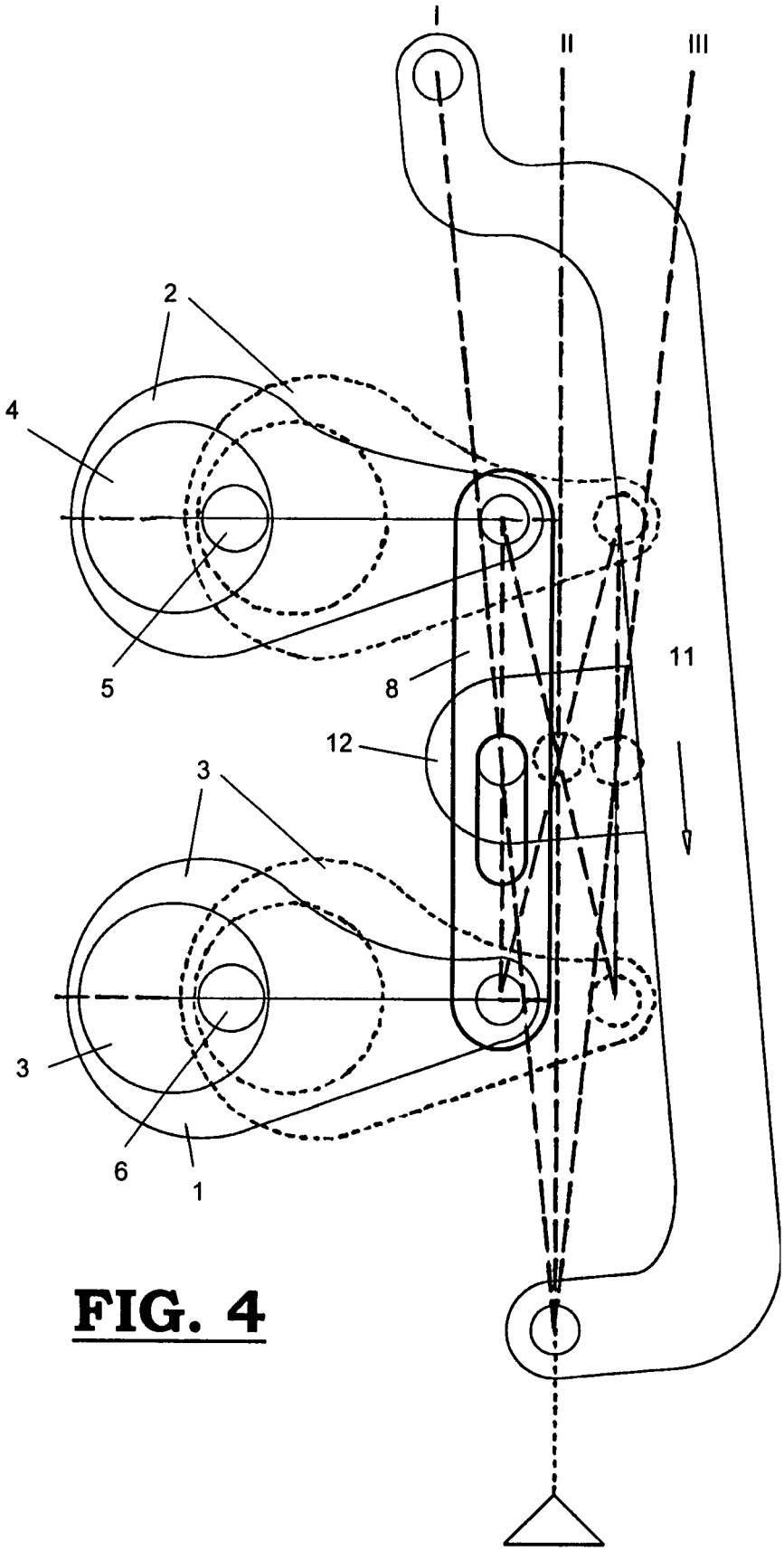
FIGS. 4 and 5 represent a schematic view of a dobby device according to the invention with an adjustable lever system for switching between a device with three and four positions.
Figure 5:
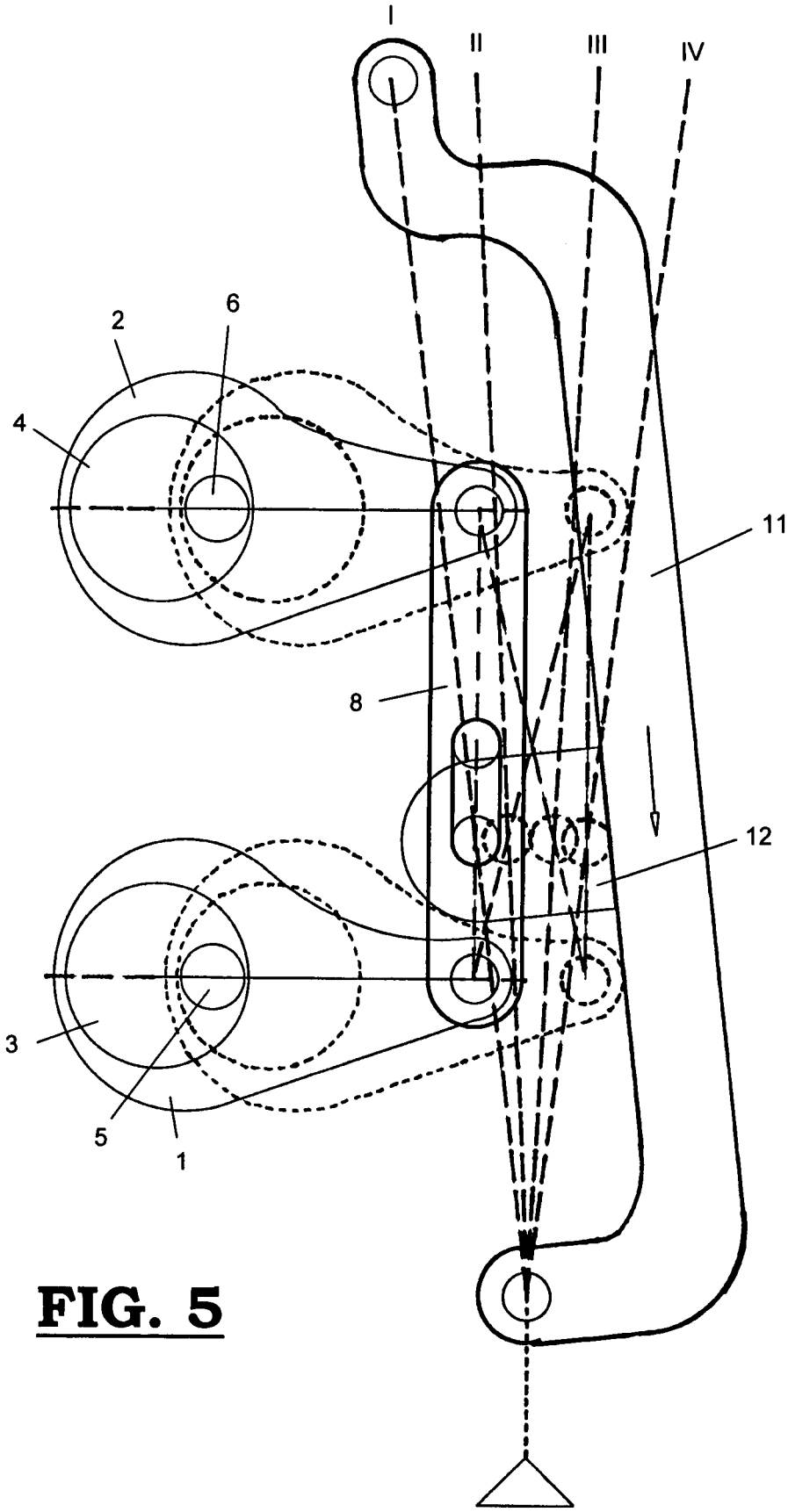

In the embodiment as represented in the FIGS. 4 and 5, both rotors (1,2) are connected to a same first lever (8) which is connected to a second lever (11) by means of a connecting rod (12). One extremity of the second lever (11) is connected hingedly on a shaft with a fixed center in the dobby device or in the weaving machine, and its other extremity is connected to a lever and rod system realizing the connection with a weaving frame. This embodiment has a number of components and pivoting points situated between the numbers of the embodiments as represented in the FIGS. 2 and 3. By exerting the coupling of the connecting rod (12) to the first lever (8) and to the second lever (11) in an adjustable manner, the positions taken up by the free extremity of the second lever (11) may be adjusted with respect to one another. This for instance allows to position the backing warp yarns in a face-to-face weaving machine asymmetrically, such that the shed forming of the backing warp yarns of the lower fabric is different from shed forming of the backing warp yarns of the upper fabric which, under certain circumstances, may be important from a weaving technological viewpoint, for instance, for guiding the weft insertion means in the lower fabric on the backing warp yarns when moving through the shed.

In the embodiment as represented in FIG. 4, the second lever (11) may impose three positions (I, II, III) on the weaving frame, whereas in the embodiment as represented in FIG. 5, the second lever (4) may impose 4 positions (I, II, II, IV) on the weaving frame. The embodiments as represented in the FIGS. 4 and 5 are different from one another only because of the fact that the connecting rod (12) provided to be adjustable in the dobby device, is taking up another position.

In the embodiment as represented in the FIGS. 2 to 5, the common second lever (11) moves in accordance with a superposition of motions generated by the first rotor (1) on the first rotor shaft (5) and generated by the second rotor (2) on the second rotor shaft (6). The two possible positions of the first rotor (1) with the two positions of the second rotor (2) thus result in four positions (I, II, II, IV) of the second lever (11).

The rod system that is constituted by the first (8,9) and second levers (11) and the possible connecting rods (12) may be chosen such that two of the four positions (I, II, II, IV) coincide, in order to be able to position the weaving frames into three positions.

The rotors (1,2) that are mounted on two different rotor shafts (5,6) and that are connected or not to a common second lever (11) by means of intermediate levers and connecting rods, preferably are situated in a same plane perpendicular to their respective rotor shafts (5,6).

The first levers (8,9) or the second lever (11) which are connected to a rotor (1,2) may be connected single-sidedly to the rotors (1,2). This means that the first lever (8,9) or the second lever (11) extend on one side of the rotor(s) (1,2) there where they are connected to each other. In this case, the levers (8,9,11) are of a simple construction, however, this embodiment is generating a couple of forces on the rotor (1,2) because of the eccentric transmission of the load of the warp yarns on the rotor (1,2) through these first (8,9) or second (11) levers. In order to avoid this, the levers (8,9,11) are preferably connected to the rotor (1,2), by means of a double-sided connection. This means that either the extremity of the rotor (1,2) is extending around the lever (8,9,11), for instance, through a radial recess at the extremity of the rotor (1,2) or that the lever (8,9,11) extends around the rotor (1,2), for instance, through a radial recess at the extremity of the lever (8,9,11). The levers (8,9,11) are in turn connected to the rod system driving the weaving frames.

The invention claimed is:

1. Electronic dobby device (100) for controlling the motions of at least one weaving frame of a weaving machine, wherein the at least one weaving frame is connected to two rotors (1,2) by means of a rod and lever system, wherein each rotor (1,2) is mounted on a rotor shaft (5,6) by means of an eccentric bearing, and wherein each rotor (1,2) is individually selected to be connected or not to the rotor shaft (5,6) by means of one or several selection elements in accordance with the weaving pattern to be woven, in order to move between two possible positions which may be taken up by the rotor (1,2) with respect to the rotor shaft when the rotor (1,2) is disconnected from the rotor shaft (5,6) by the selection elements, wherein the said two rotors (1,2) each are eccentrically journalled on a different rotor shaft (5,6) and both rotor shafts (5,6) are rotating continuously and for rotating over a complete rotation require the same period of time, and in that the said weaving frame can take up at least three different positions during each machine cycle to weave the required weaving pattern.

2. Electronic dobby device according to claim 1, wherein both said rotor shafts (5,6) are rotating in the same direction.

3. Electronic dobby device according to claim 1, wherein both said rotor shafts (5,6) are rotating in an opposite direction.

4. Electronic dobby device according to claim 1, wherein in order to attain a standstill to couple a rotor (1,2) to its respective rotor shaft (5,6), the rotating motion of both rotor shafts (5,6) is modulated, wherein this modulation is the same for both rotor shafts (5,6).

5. Electronic dobby device according to claim 1, wherein in order to attain a standstill to connect a rotor (1,2) to its respective rotor shaft (5,6), the rotating motion of both rotor shafts (5,6) is modulated, this modulation being different for both rotor shafts (5,6).

6. Electronic dobby device according to claim 1, wherein the weaving machine is provided with a main drive shaft, wherein both rotor shafts (5,6) are mechanically connected to this main driving shaft.

7. Electronic dobby device according to claim 1, wherein both rotor shafts (5,6) are driven by one and the same stepping motor or servomotor (7) with an intermediate driving mechanism with an input shaft that is connected to the output shaft of the stepping motor or servomotor and with two output shafts each of them connected to one of the two rotor shafts (5,6).

8. Electronic dobby device according to claim 1, wherein both rotor shafts (5,6) each are separately driven by a stepping motor or a servomotor (7).

9. Electronic dobby device according to claim 7, wherein a control is provided for coordinating the synchronization of the drive of the said rotor shafts (5,6) with the main drive shaft of the weaving machine.

10. Electronic dobby device according to claim 7, wherein the selection elements that select whether the rotors (1,2) are connected or not to the rotor shafts (5,6) are carried out as actuators realizing the connection and disconnection between the rotor and rotor shaft.

11. Electronic dobby device according to claim 1, wherein the extremities of each of both rotors (1,2) are connected to a first lever (8,9) that hinges around a shaft (10) with a fixed center axis and wherein the two first levers (8,9) are connected to a common second lever (11).

12. Electronic dobby device according to claim 11, wherein the first levers (8,9) are connected to the common second lever (11) by means of one or several rods (12).

13. Electronic dobby device according to claim 11, wherein the first levers (8,9) are directly connected to the common second lever (11), wherein one of the rotors (1,2) are connected to a fixed point (14) through a hinged arm (13).

14. Electronic dobby device according to claim 11, wherein the second lever (11) moves in accordance with a superposition of motions that are generated by the first rotor (1) on the first rotor shaft (5) and of motions generated by the second rotor (2) on the second rotor shaft (6) enabling the second lever (11) to reach four positions (I, II, II, IV).

15. Electronic dobby device according to claim 11, wherein the rod system formed by the said first and second levers (8,9,11) and the possible connecting rods (12) is provided in such a way that two of the four positions which may be taken up by the second lever coincide, in order to enable the weaving frames to be brought into three positions (I, II, III).

16. Electronic dobby device according to claim 1, wherein both rotors (1,2) are connected to one and the same first lever (8 or 9) which is connected to a second lever (11) by means of a connecting rod (12).

17. Electronic dobby device according to claim 16, wherein the second lever (11) at one extremity hingedly is connected to a shaft (10) with a fixed center, and in that the other extremity is connected to a lever and rod system realizing the connection with a weaving frame.

18. Electronic dobby device according to claim 16, wherein the couplings of the connecting rod to the first and second lever respectively (8,9,11) are adjustable, through which the positions taken up by the free extremity of the second lever (11) are adjusted with respect to one another.

19. Electronic dobby device according to claim 1, wherein both rotors (1,2) are installed in a same plane perpendicular to their respective rotor shafts (5,6).

20. Electronic dobby device according to claim 11, wherein the first levers (8,9) or the second lever (11) are connected to their respective rotors by means of a single-sided connection.

21. Electronic dobby device according to claim 11, wherein the first levers (8,9) or the second lever (11) are connected to their respective rotors by means of a double-sided connection.

22. Electronic dobby device according to claim 1, wherein the rotors (1,2) are installed next to each other on their respective rotor shafts (5,6) at a pitch which is equal to the pitch at which the weaving frames are installed in the weaving machine one after the other.

23. Electronic dobby device according to claim 1, wherein the rotors (1,2) have a thickness substantially corresponding to the thickness of a weaving frame.

24. Weaving machine provided with an electronic dobby device according to claim 1.

* * * * *